US005476333A

United States Patent [19]

Matthews

[11] Patent Number: 5,476,333

[45] Date of Patent: Dec. 19, 1995

[54] HYGIENIC TOOTHBRUSH

[76] Inventor: Georgianne E. Matthews, P.O. Box 593, Carmel, Calif. 93921

[21] Appl. No.: 231,753

[22] Filed: Apr. 25, 1994

[51] Int. Cl.[6] ..... A46B 11/00

[52] U.S. Cl. ..... 401/132; 401/134; 401/268; 401/269

[58] Field of Search ..... 401/134, 132, 401/268, 269

[56] References Cited

U.S. PATENT DOCUMENTS

| | | | |
|---|---|---|---|
| 3,485,562 | 12/1969 | Hidden et al. | 401/134 |
| 3,589,823 | 6/1971 | Hendrickson | 401/132 X |
| 4,588,089 | 5/1986 | Yanz, Jr. et al. | 401/132 X |
| 4,844,641 | 7/1989 | Grosfilley et al. | 401/132 X |
| 5,061,106 | 10/1991 | Kent | 401/268 |

FOREIGN PATENT DOCUMENTS

| | | | |
|---|---|---|---|
| 389711 | 10/1990 | European Pat. Off. | 401/268 |
| 2554331 | 5/1985 | France | 401/132 |
| 928553 | 6/1955 | Germany | 401/269 |
| 8801839 | 3/1988 | WIPO | 401/268 |

*Primary Examiner*—Steven A. Bratlie

[57] ABSTRACT

A hygienic toothbrush wherein the brush portion is carried in contact with a sterilizing solution after use. To avoid spillage, the sterilizing solution is contained in a small, replaceable, plastic container which is inserted into the back of the brush and perforated to release a small quantity of solution into a chamber in communication with the brush head during storage and transport thereof. Should damage occur to the brush and its carrier during the storage phase, only minimal spillage of the sterilizing liquid can occur. The toothbrush is made foldable to provide a small size for storage.

2 Claims, 4 Drawing Sheets

HYGIENIC TOOTHBRUSH

BACKGROUND OF THE INVENTION

1. Field of the Invention

The present invention relates to travel toothbrushes and more particularly pertains to a toothbrush which may be sterilized after use and during transport thereof.

2. Description of the Prior Art

The use of toothbrushes and associated sterilizing cases is known in the prior art. More specifically, such brushes heretofore devised and utilized for the purpose of conveniently transporting such brushes are known to consist basically of familiar, expected and obvious structural configurations, notwithstanding the myriad of designs encompassed by the crowded prior art which have been developed for the fulfillment of countless objectives and requirements. Sterilization has been provided by use of storage carrying sterilizing fluid (U.S. Pat. No. 4,214,657); by contact with fumes (U.S. Pat. No. 5,086,916); and by the use of heat (U.S. Pat. No. 4,816,648). Also, hinges have been provided in the handles of toothbrushes to permit folding the units into smaller sizes for travel, e.g. U.S. Pat. Nos. 5,003,658 and 4,979,258. Generally, where liquid sterilizing media has been included as a component, the volume is sufficient for multiple long term use causing a potential leakage or spillage situation and since the residue in contact with contaminated bristles usually drains back into the reservoir for such liquid, the possibility for contamination by reuse of such liquid exists.

In this respect, the hygienic toothbrush according to the present invention substantially departs from the conventional concepts and designs of the prior art, and in so doing provides an apparatus primarily developed for the purpose of providing one-use sterilization of a toothbrush using a minimum of liquid media.

Therefore, it can be appreciated that there exists a continuing need for new and improved hygienic toothbrushes which can be safely stored and transported with minimum risk of spillage of the sterilizing solution and no possibility of contamination by reuse of such solution. In this regard, the present invention substantially fulfills this need.

SUMMARY OF THE INVENTION

In view of the foregoing disadvantages inherent in the known types of toothbrushes now present in the prior art, the present invention provides an improved hygienic toothbrush construction wherein the same can be utilized for transport free of contamination danger or spillage of any significant amount of sterilizing solution. As such, the general purpose of the present invention, which will be described subsequently in greater detail, is to provide a new and improved hygienic travel toothbrush which has all the advantages of the prior art brushes and none of the disadvantages.

To attain this, the present invention essentially comprises a hygienic toothbrush wherein the brush portion is carried in contact with a sterilizing solution after use. To avoid spillage, the sterilizing solution is contained in a small, replaceable, plastic container which is inserted into the back of the brush and perforated to release a small quantity of solution into a chamber in communication with the brush head during storage and transport thereof. Should damage occur to the brush and its carrier during the storage phase, only minimal spillage of the sterilizing liquid can occur. The toothbrush is made foldable to provide a small size for storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hygienic toothbrush which has all the advantages of the prior art toothbrushes and none of the disadvantages.

It is another object of the present invention to provide a new and improved hygienic toothbrush which may be easily and efficiently manufactured and marketed.

It is a further object of the present invention to provide a new and improved hygienic toothbrush which is of a durable and reliable construction.

An even further object of the present invention is to provide a new and improved hygienic toothbrush which is susceptible of a low cost of manufacture with regard to both materials and labor, and which accordingly is then susceptible of low prices of sale to the consuming public, thereby making such toothbrushes economically available to the buying public.

Still yet another object of the present invention is to provide a new and improved hygienic toothbrush which provides in the apparatuses and methods of the prior art some of the advantages thereof, while simultaneously overcoming some of the disadvantages normally associated therewith.

Still another object of the present invention is to provide a new and improved folding type hygienic toothbrush.

Yet another object of the present invention is to provide a new and improved hygienic toothbrush wherein fresh sterilizing liquid is provided after each use.

Even still another object of the present invention is to provide a new and improved essentially spill-free hygienic travel toothbrush.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
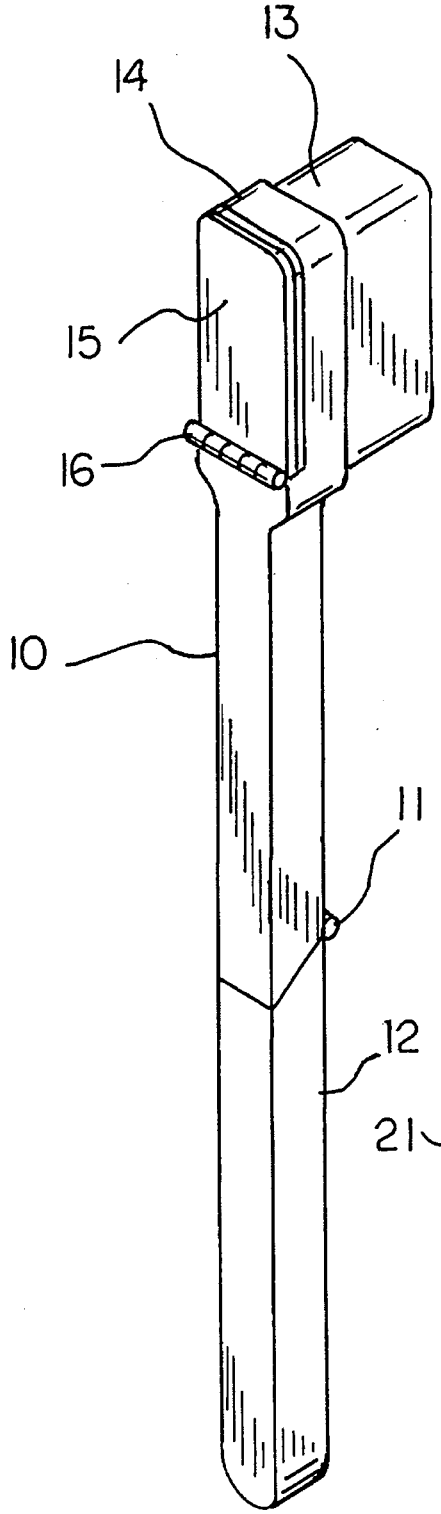
FIG. 3 is a perspective view of the toothbrush of the present invention in an open condition ready for use.

With reference now to the drawings, and in particular to FIG. 3 thereof, a new and improved hygienic toothbrush embodying the principles and concepts of the present invention and generally designated by the reference numeral 10 will be described.

Figure 1:
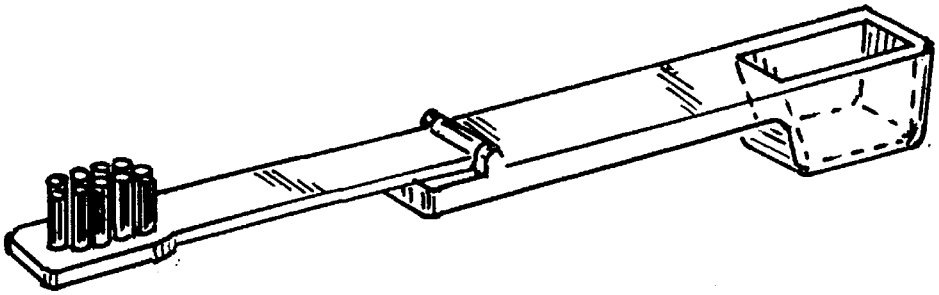
FIG 1 PRIOR ART
FIG. 1 is a perspective view of a folding toothbrush known in the prior art.
Figure 2:
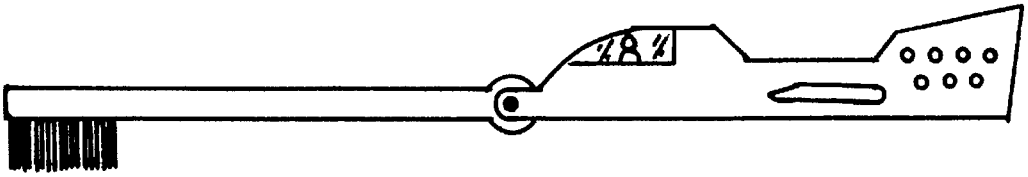
FIG 2 PRIOR ART
FIG. 2 is a side plan view of another type of prior art folding toothbrush.

More specifically, it will be noted that in FIGS. 1 and 2, prior art travel toothbrushes are illustrated showing that the concept of folding handles to reduce storage size is well known. It should be noted that in these configurations the bristles on the toothbrush head drop into enclosed wells when the brush is folded. While the brush head well in FIG. 2 is perforated to facilitate drying, germs on the bristles can and will breed when the brushes are stored.

FIG. 3 illustrates the brush 10 of the present invention which, like the prior art, is designed to fold utilizing a hinge 11 on handle 12. As is shown in detail in FIG. 4, brush 10 carries on its head 13 a compartment 14 with a closure member 15 attached to handle 12 by another hinge 16.

Figure 4:
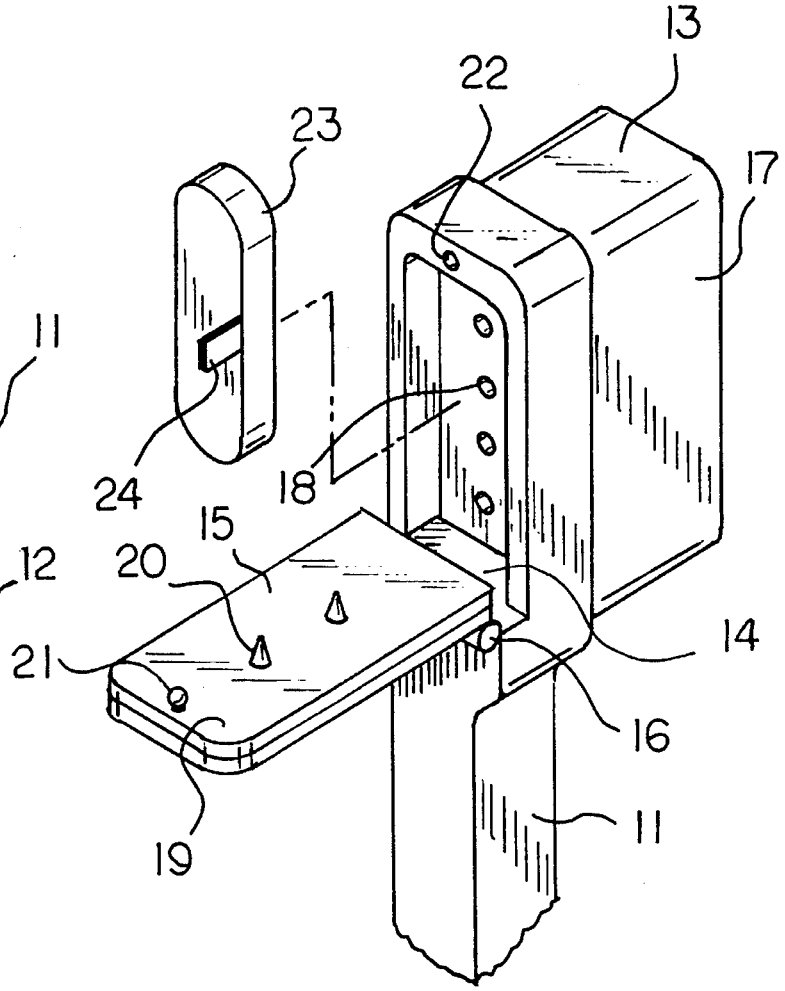
FIG. 4 is an enlarged partially exploded perspective view of the head portion of the toothbrush of the present invention.

FIG. 4 shows compartment 14 (which is positioned at the rear of head 13 behind bristles 17) venting into the area occupied by bristles 17 through a plurality of ports 18. Hinged closure member 15 has, on its inner face 19, a plurality of sharp, pointed projections 20 and a locking stud 21 adapted to engage with a locking recess 22 on the surface of compartment 14 when member 15 is in closed position. A plurality of small, sealed, plastic cartridges 23 containing a sterilizing fluid such as alcohol or any of the commercially available disinfectants non-injurious to oral tissues are provided along with brush 10 (only one being shown here). The cartridge 23 has a small paper or plastic tab 24 to facilitate handling attached thereto. Cartridge 23 is sized to fit within compartment 14 and when placed within such compartment 14 and member 15 is closed, projections 20 perforate cartridge 23 releasing its content of sterilizing fluid into chamber 14 and thence through ports 18 into the area of bristles 17.

Figure 5:
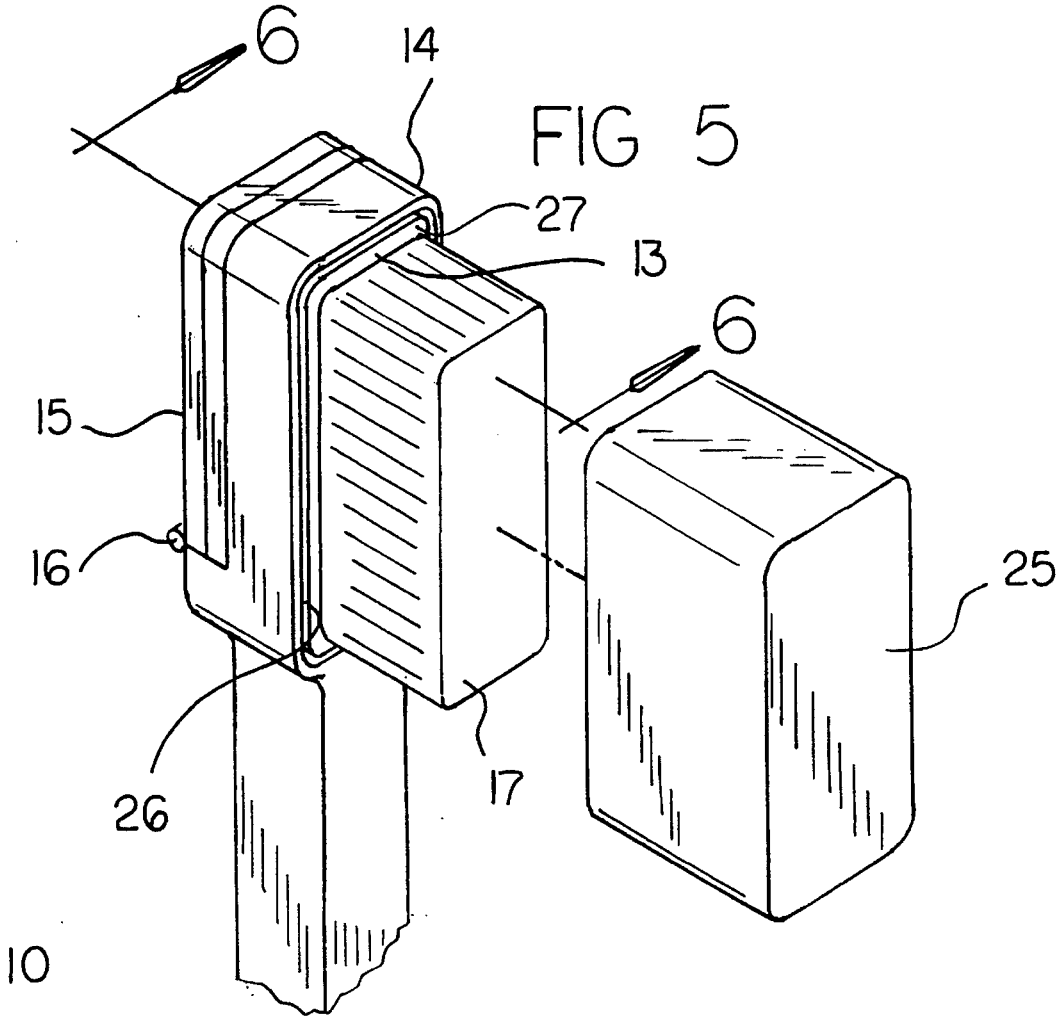
FIG. 5 is a further enlarged perspective view of the head portion of the toothbrush of the present invention showing the cover for the bristles thereof.
Figure 6:
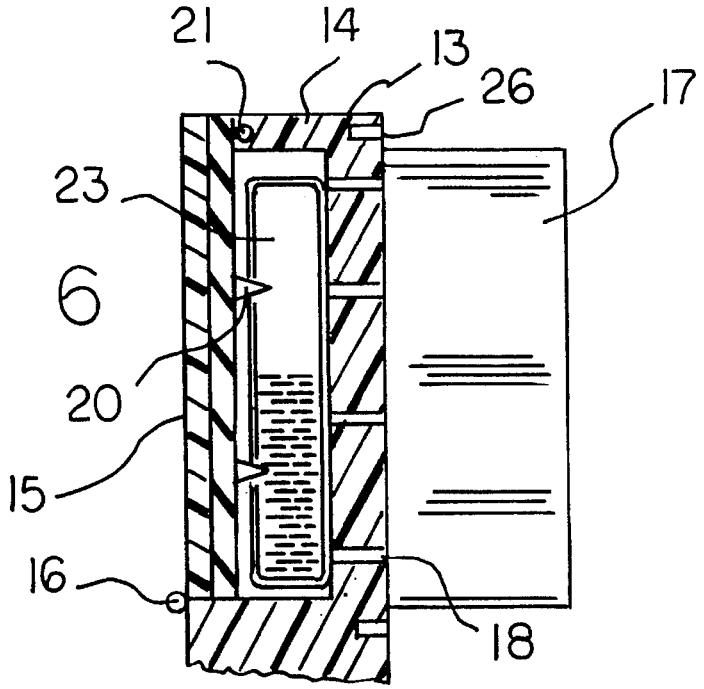
FIG. 6 is a sectional view on line 6—6 of FIG. 5.
Figure 8:
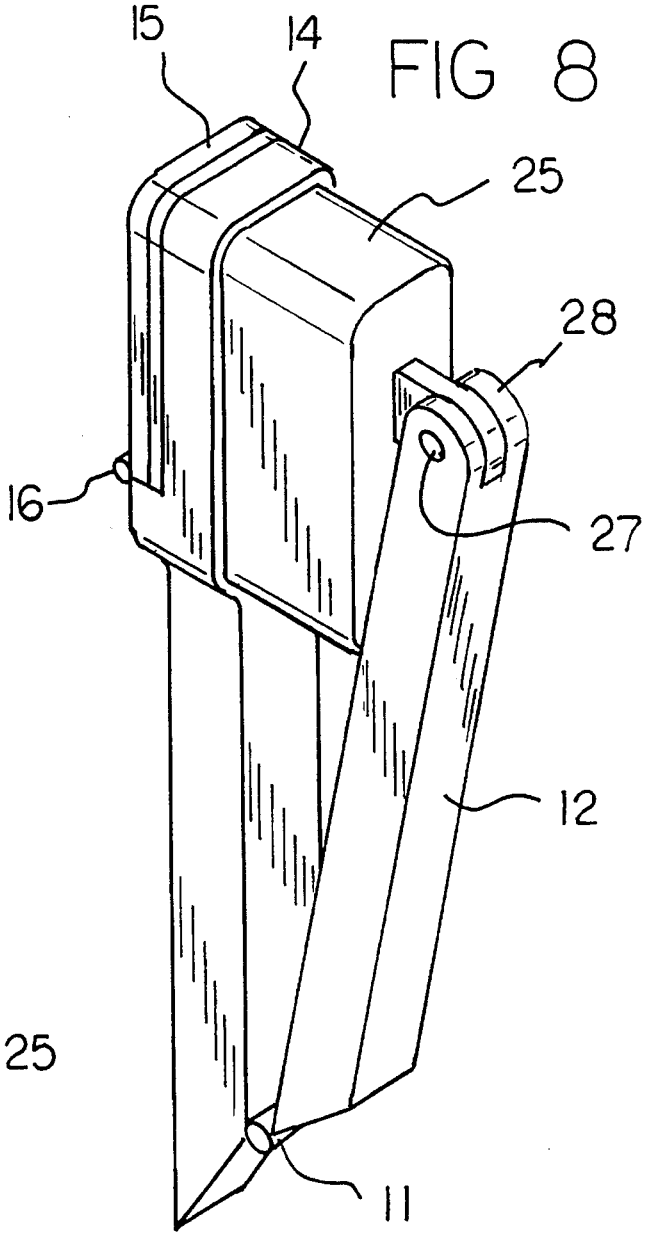
FIG. 8 illustrates the brush of FIG. 7 in a folded travel position.

Referring now to FIG. 5, a snap-on bristle cover 25 is provided. Cover 25 fits over bristles 17 in fluid-tight relationship to head 13 by engagement with sealing recess 26 which extends around the base of bristles 17 on the front surface 27 of head 13. In preparing brush 10 for closure and storage, a cartridge 23 is dropped into chamber 14 and the closure member 15 is swung into place and closed by engagement of locking stud 21 with locking recess 22. The brush 10 is placed on its back with bristles 17 projecting upwardly to prevent loss of the sterilizing fluid now freed from cartridge 23 and free to drain into compartment 14 as shown in the sectional view of FIG. 6. Cover 25 is snapped into place over bristles 17 and the brush 10 is ready to be folded into its travel position as shown in FIG. 8. The sterilizing fluid from compartment 14 will pass through ports 18 into bristles 17 with which it will remain in contact until the next usage of brush 10. It should be noted that the present invention obviates the loss or spillage of sterilizing fluid when the loading it into the toothbrush 10 since such fluid is contained within the sealed capsule or cartridge 23 until after it has been placed within compartment 14 of brush 19. Furthermore, since the amount of sterilizing fluid is very limited, accidental dislodgement of the sealing cover 25 will cause minimal damage to items with which brush 10 may be in contact. This is particularly true when compared to brushes containing large reservoirs of fluid or which may be stored in carrying cases having large quantities of such fluid therein. Likewise, no contamination of the sterilizing fluid is possible since each cartridge provides a "one-shot" dosage of such fluid which is not reused.

Figure 7:
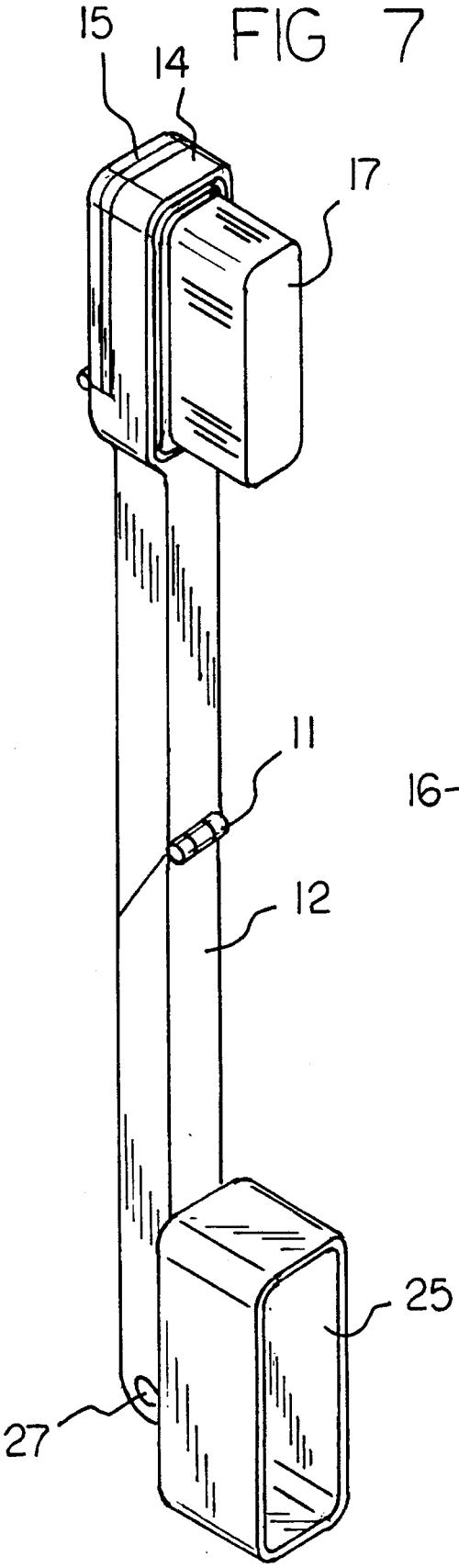
FIG. 7 is a perspective view of the present toothbrush showing a modification thereof.

FIGS. 7 and 8 show a modification wherein cover 25 is placed on the base of handle 12 and, where swung into closed position as shown in FIG. 8, engages with recess 26 as described above. To permit proper engagement, cover 25 is hinged to the end of handle 12 by a pivot pin 27 carried by flanges 28 on the end of handle 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothbrush comprising:

handle; the handle having a first end and a second end, a brush head coupled to the first end of the handle, the brush head being shaped so as to define a compartment and a plurality of ports extending through said brush head to a front face thereof permitting fluid communication from the compartment through to the front face, said brush head further being shaped so as to define a sealing recess extending about the front face thereof proximal to a periphery of the brush head;

a plurality of bristles projecting from the front face of the brush head, the bristles being located along the front face of the brush head so as to be surrounded by the sealing recess;

a closure member having a hinge pivotally mounting the closure member to the brush head for enclosing the compartment thereof, said closure member having a plurality of pointed projections extending Into the compartment;

a cartridge positioned within the compartment of the brush head, with the pointed projections piercing the cartridge to permit fluid communication between an interior of the cartridge and the compartment;

a sterilizing fluid positioned within the cartridge;

and, a cover removably coupled to the brush head and extending into the sealing recess to completely enclose the bristles, whereby the toothbrush can be manually manipulated to effect dispensing of the sterilizing fluid from the cartridge into the compartment such that the sterilizing fluid can flow through the ports and into contact with the bristles to sterilize the bristles.

2. The toothbrush of claim 1, wherein the handle has a handle hinge between the first end and the second end for folding the handle for storage; the cover is pivotally secured to the handle adjacent the second end.

* * * * *